US010875037B2

(12) United States Patent
Lin et al.

(10) Patent No.: US 10,875,037 B2
(45) Date of Patent: Dec. 29, 2020

(54) WATERWAY SWITCHING MECHANISM AND SHOWER COMPRISING THE WATERWAY SWITCHING MECHANISM

(71) Applicant: XIAMEN SOLEX HIGH-TECH INDUSTRIES CO., LTD., Fujian (CN)

(72) Inventors: Fengde Lin, Fujian (CN); Mingfu Zhang, Fujian (CN); Tianming Wang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 63 days.

(21) Appl. No.: 16/026,900

(22) Filed: Jul. 3, 2018

(65) Prior Publication Data

US 2019/0143346 A1 May 16, 2019

(30) Foreign Application Priority Data

Nov. 15, 2017 (CN) ..... 2017 1 1131474

(51) Int. Cl.

| | |
|---|---|
| ***B05B 1/18*** | (2006.01) |
| ***B05B 1/16*** | (2006.01) |
| ***B05B 1/12*** | (2006.01) |
| ***B05B 12/00*** | (2018.01) |
| *E03C 1/04* | (2006.01) |

(52) U.S. Cl.

CPC ..... *B05B 1/18* (2013.01); *B05B 1/12* (2013.01); *B05B 1/169* (2013.01); *B05B 1/1609* (2013.01); *B05B 12/002* (2013.01); *E03C 1/0405* (2013.01)

(58) Field of Classification Search

CPC .... B05B 1/12; B05B 1/18; B05B 1/16; B05B 1/1609; B05B 1/169; B05B 12/002; E03C 1/0405; Y10T 137/86928; Y10T 137/87024; Y10T 137/87064

USPC ..... 239/436, 443–449; 137/628, 630.2, 137/630.21

See application file for complete search history.

(56) References Cited

U.S. PATENT DOCUMENTS

| | | | | |
|---|---|---|---|---|
| 2,934,091 A * | 4/1960 | Chapou | F16K 31/52416 137/628 |
| 5,398,725 A * | 3/1995 | Nakazawa | F16K 11/165 137/636.1 |
| 9,394,259 B2 * | 7/2016 | Zhou | B05B 1/1636 |

FOREIGN PATENT DOCUMENTS

| | | |
|---|---|---|
| CN | 204083300 U | 1/2015 |
| CN | 205013826 | 2/2016 |

* cited by examiner

*Primary Examiner* — Jason J Boeckmann
(74) *Attorney, Agent, or Firm* — Cooper Legal Group, LLC

(57) ABSTRACT

A waterway switching mechanism in a shower includes a fixed portion and a rotating block connected to a fixed portion. The fixed portion has a plurality of switching positions each with a sealing portion that can move relative to the fixed portion in the first direction. The waterway switching is controlled through the activity of the sealing portion. The outside wall is provided with a pushing portion. The sealing portions are circumferentially spaced apart and surround outside of the rotating block. Each sealing portion is provided with a fitting portion capable of cooperating with the pushing portion, when the rotating block rotates the pushing portion follows the rotating block and move in a circumferential direction, and the fitting portion is driven to move in the first direction by a circumferential movement of the pushing portion, and the first direction intersects with vertical plane of the vertical swivel axis of rotation.

20 Claims, 12 Drawing Sheets

WATERWAY SWITCHING MECHANISM AND SHOWER COMPRISING THE WATERWAY SWITCHING MECHANISM

TECHNICAL FIELD

The invention relates to a waterway switching mechanism, in particular to a waterway switching mechanism and a shower containing the waterway switching mechanism.

BACKGROUND TECHNOLOGY

The existing waterway switching mechanism includes a fixed portion and a rotating shaft, which is connected to a fixed portion. The fixed portion is provided with a plurality of water separation holes, and each water separation hole is provided with a sealing portion which can move relative to the fixed portion along the axial direction, and the waterway switching is controlled through the movement of the sealing portion. The sealing portions are arranged around the axis of the rotating shaft, and the circumferentially arranged sealing portion and the rotating shaft are arranged along the axis. The end face of the rotating shaft is concave with grooves, and the groove is selected to align one sealing portion by rotating the rotating shaft. Then the sealing portion moves into the groove to open the water separation hole, so as to realize switching, and the specific structure is as in CN204083300U. The waterway switching mechanism has the following shortcomings: 1, the distance along the axis is long, the occupancy space is large, the use situation is limited; 2, the end face of the rotating shaft and the surface of the fixed portion contact, the rotating wear is large, the friction force is large.

The existing other waterway switching mechanism is different from the above water switching mechanism. The sealing portion has a moving direction of radial movement, and a cam mechanism is arranged at the rotating shaft, and the sealing portion is pushed against the sealing portion through the outer circumferential surface of the cam to realize the switching of the sealing portion, and the specific structure is as CN205013826U. The waterway switching mechanism also has the following deficiencies: the sealing portion move radially, the radial distance is large, it occupy a large space, the use of the occasion is limited.

SUMMARY OF THE INVENTION

The invention provides a waterway switching mechanism and a shower containing the waterway switching mechanism, which overcomes the shortcomings of the waterway switching mechanism and the shower containing the waterway switching mechanism in the background technology.

The first technical solution adopted by the invention to solve the technical problems is that: The waterway switching mechanism includes a fixed portion, and the fixed portion is provided with a plurality of switching positions, each of which is provided with a sealing portion that can move relative to the fixed portion in the first direction, and the sealing portion movement controls the waterway switching; it also includes a rotating block which is connected rotatingly to the fixed portion, and the outer peripheral wall of the rotating block is provided with a pushing portion, a plurality of sealing portions is circumferentially spaced apart and surrounds the rotating block, each of the sealing portions is provided with a fitting portion which can fit with the pushing portion, when the rotating block rotates, the pushing portion is driven by the rotating block to move circumferentially, which drives the fitting portion to move along the first direction, the first direction intersects the vertical plane of the rotating axis of the vertical rotating block.

In an embodiment, each of the sealing portions is provided with an elastic body capable of acting on the sealing portion to generate the elastic force toward the switching position, the positive circumferential movement of the pushing portion drives the fitting portion to move forward in the first direction and compress the elastic body for the energy storage, and the elastic body can release energy and drive the sealing portion to move in the negative direction in the first direction to reset.

In an embodiment, the rotation axis of the rotating block is parallel to the first direction.

In an embodiment, the circumference wall of the rotating block is provided with a protrusion, which has a positive guiding surface and a negative guiding surface, the positive guiding surface and the negative guiding surface is connected together; the positive guiding surface extends circumferentially in the positive direction of the rotating axis of the rotating block and the height also advances gradually in a positive direction toward the first direction, the negative guiding surface extends circumferentially in the positive direction of the rotating axis of the rotating block, the height also retreats gradually in a positive direction toward the first direction, due to the positive guiding surface and the circumferential movement, the fitting portion is driven to move in the positive direction in the first direction, due to the negative guiding surface and the circumferential movement, the fitting portion drives the fitting portion to gradually move in the negative direction in the first direction.

In an embodiment, the periphery of the rotating block is provided with a ring protrusion, and the upper ring surface of the protrusion ring is fixed with a protrusion. The protrusion has a positive guiding surface, and the positive guiding surface extends circumferentially in the positive direction of the rotating axis of the rotating block and the height also advances gradually in a positive direction toward the first direction.

In an embodiment, the fitting portion includes a lug at the outer surface of the sealing portion, and the lug and the pushing portion can be matched.

In an embodiment, the guiding mechanism is arranged between the fixed portion and the sealing portion.

In an embodiment, the fixed portion comprises a water separation waterway portion and a fixed seat, the water separation portion and the fixed seat are fixed together and is composed of a water separation chamber; the water separation chamber corresponding to the water separation waterway portion is provided with the above switching position, at least one switching position is a water separation hole, at least one water separation waterway corresponding to the water separation hole is arranged in the water separation waterway portion; the rotating block can rotate to connect the water separation waterway portion and extend out of the fixed seat.

In an embodiment, the bottom of the fixed seat is provided with a concave groove, the sealing portion is provided with a hollow hole penetrating up and down, an upper sealing ring and a lower sealing ring are arranged on the outer wall of the sealing portion, the upper portion of the sealing portion is always adapted to be slidably connected to the groove, the sealing portion moves up and down to control the lower sealing ring to seal the switching position to close the switching position or away from the switching position to open the switching position.

In an embodiment, at least one water separation waterway is provided with at least two water outlet ports, and at least two water outlet ports are equipped with one-way valves.

In an embodiment, at least one switching position is a blind hole.

In an embodiment, it also includes a driving mechanism, which consists of an intermittent movement mechanism, which connects the rotating block to drive the rotating block to rotate in positive direction.

In an embodiment, the intermittent movement mechanism includes the ratchet pawl mechanism.

In an embodiment, the intermittent movement mechanism comprises a rack, a first rotary plate and a second rotary plate, wherein the first rotary plate is formed with gear tooth on the peripheral wall, the rack engages with the first rotary plate, the first rotary plate has a first ratchet at its end face, the second ratchet tooth is arranged on the end face of the second rotary plate, and the first ratchet tooth and the second ratchet tooth are meshed with each other.

In an embodiment, the intermittent movement mechanism comprises a pull rod, a first rotary plate and a second rotary plate, the pull rod cooperating with the first rotary plate to drive the first rotary plate to rotate through the pull rod movement; the first rotary plate end face is provided with a first ratchet tooth, the second rotary plate end face is provided with a second ratchet tooth, the first ratchet tooth meshes with the second ratchet tooth.

The second technical solution adopted by the present invention for solving the technical problem is as follows:

The waterway switching mechanism includes a fixed portion, and the fixed portion is provided with a plurality of switching position, each of which is provided with a sealing portion that can move relative to the fixed portion in the first direction, and controls the waterway switching through the sealing portion movement, wherein comprising: it also includes a rotating block which is connected rotatingly to the fixed portion, and the outer peripheral wall of the rotating block is provided with a pushing portion, the pushing portion has a positive guiding surface, the positive guiding surface extends circumferentially in the positive direction of the rotating axis of the rotating block and the height also advances gradually in a positive direction toward the first direction, a plurality of sealing portions are circumferentially spaced apart and surrounds outside of the rotating block, each of the sealing portions is provided with a fitting portion which can fit with the positive guiding surface, when the rotating block rotates, the positive guiding surface is driven by the rotating block to move circumferentially, which drives the fitting portion to move along the first direction.

The third technical solution adopted by the invention to solve the technical problems are as follows:

A shower containing any waterway switching mechanism in the claim 1 or 16, wherein comprising: it also includes a face cover and a body, the body has a handle portion and the rear cover, the face cover and the rear cover are fixedly connected together and forms a installation space, the fixed portion is installed in the installation space, it also is provided with the operating member, the operating member is movably connected with the fixed portion and drive the rotating block to rotate through the movement of the operating member.

Compared with the background technology, the technical solution has the following advantages:

The plurality of sealing portions are circumferentially spaced apart and surround outside of the rotating block, the first direction intersects the vertical plane of the axis of rotation of the vertical rotating piece, the pushing portion follows the rotating block for circumferential movement as the rotating block rotates, the pushing portion move circumferentially to drive the fitting portion to move along the first direction, the layout is rational, the structure is compact, not only to avoid that the axial distance is too long, but also to avoid that the radial distance is too large, the use range is large. Moreover, during the rotation of the rotating block, in addition to the inevitable connection, only the fitting portion and the pushing portion contact, the contact area is reduced, reduce the friction is reduced and the service life is extend.

The pushing portion has a positive guiding surface, the positive guiding surface extends circumferentially in the positive direction of the rotating axis of the rotating block and the height also advances gradually in a positive direction, the plurality of sealing portions are circumferentially spaced apart and surrounds outside of the rotating block; each of the sealing portions is provided with a fitting portion which can fit with the positive guiding surface, when the rotating block rotates, the positive guiding surface is driven by the rotating block to move circumferentially, which drives the fitting portion to move along the first direction. The layout is reasonable, the structure is compact, not only to avoid a longer axial distance, but also to avoid a large radial distance, the use of range is wide, the contact area is reduced, the friction is reduced and the service life is extended. The rotation axis of the rotating is parallel to the first direction, and the layout is reasonable and the structure is more compact.

The protrusion has a positive guiding surface, which drives the fitting portion to move forward along the first direction through the positive guiding surface and circumferential movement, reducing friction force, saving effort, and the operation accuracy is high.

ILLUSTRATING THE DRAWINGS

This invention is further explained in conjunction with the accompanying drawings and embodiments.

FIG. 13-1 is a schematic diagram of the structure of the driving mechanism of the fourth embodiment.

FIG. 13-2 is a schematic diagram of the structure of the first rotary plate in the fourth embodiment.

FIG. 13-3 is a schematic diagram of the structure of the second rotary plate in the fourth embodiment.

SPECIFIC IMPLEMENTATION METHODS

Figure 1:
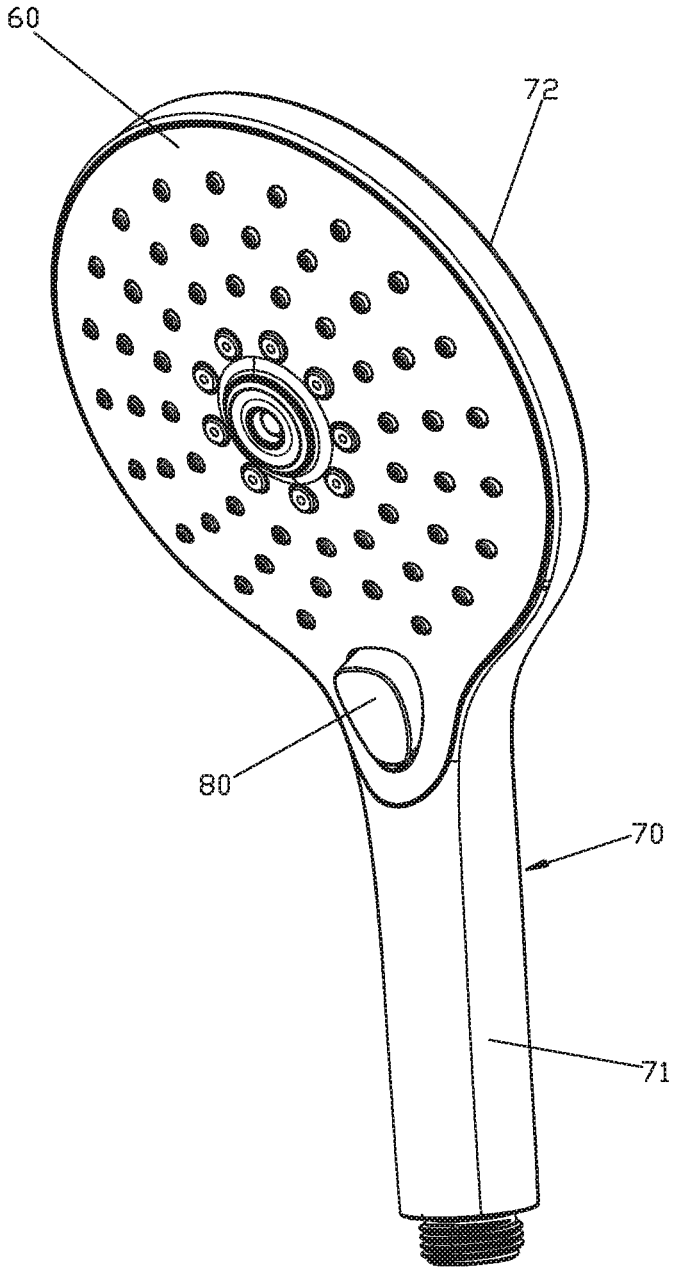
FIG. 1 is a stereoscopic schematic view of the shower.
Figure 2:
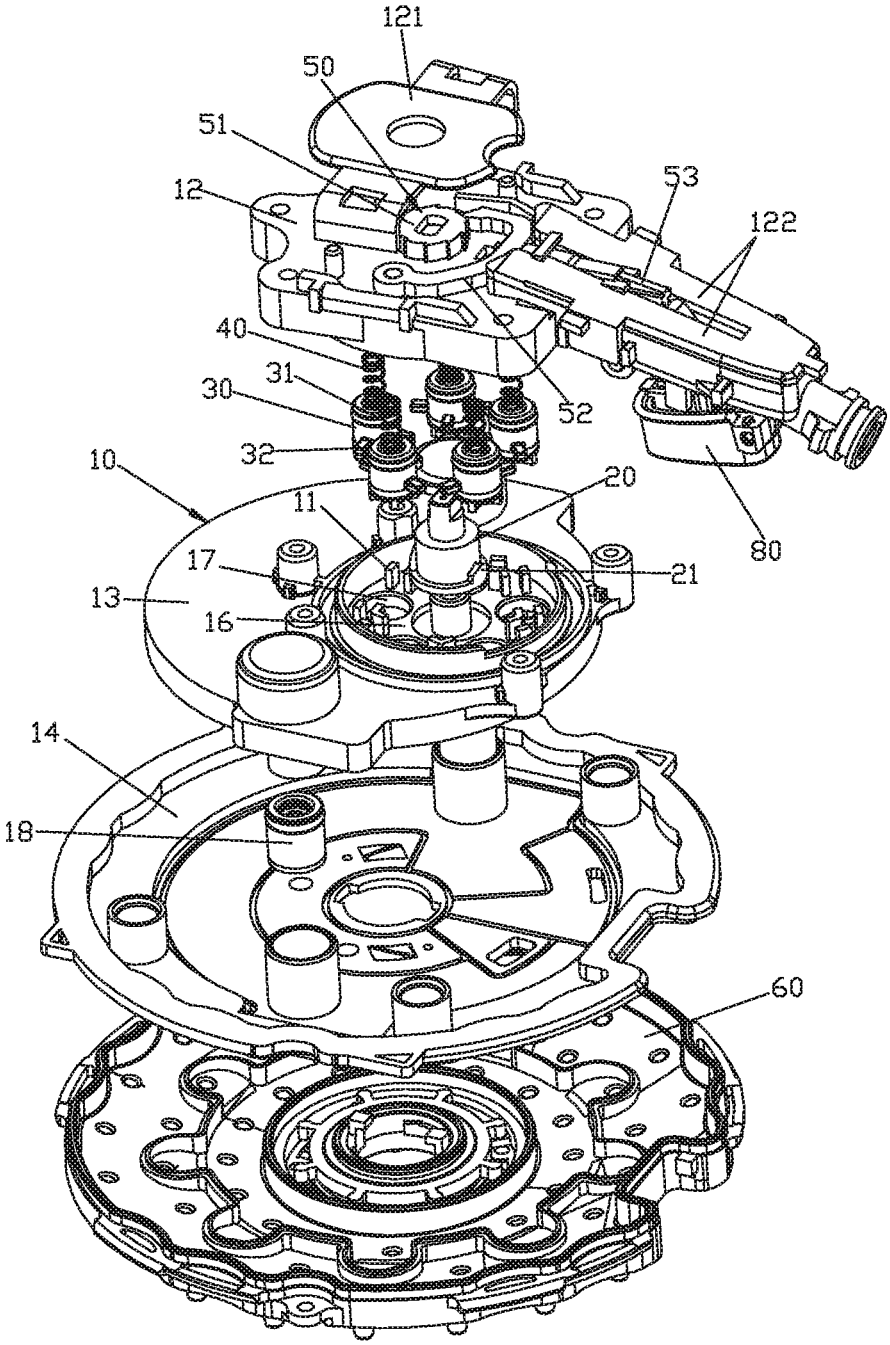
FIG. 2 is a schematic view of the local stereoscopic decomposition of the shower.
Figure 3:
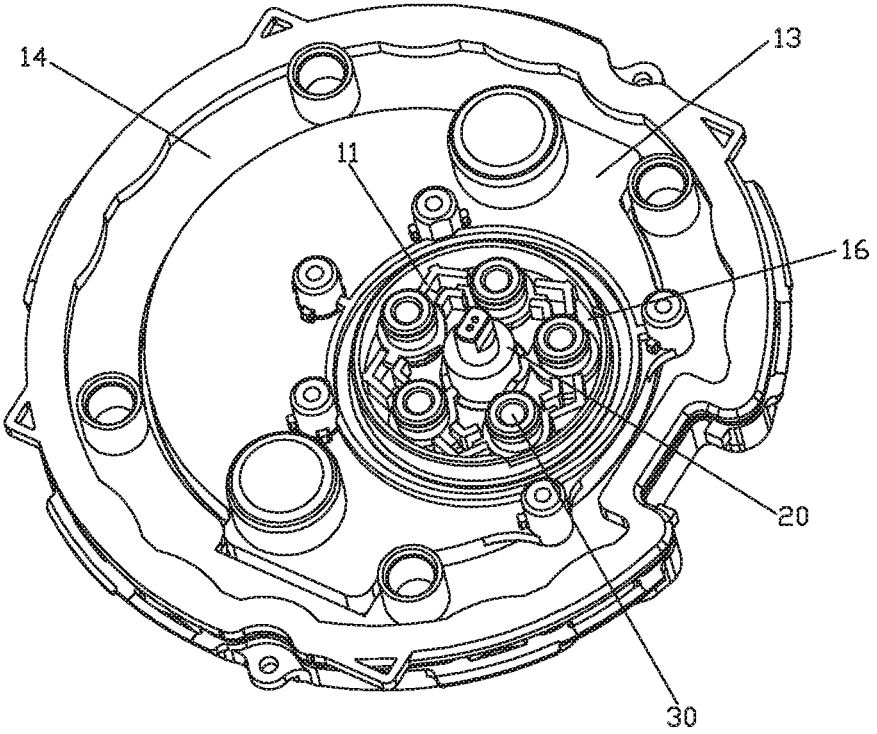
FIG. 3 is a stereoscopic schematic view of the local assembly of the shower.
Figure 4:
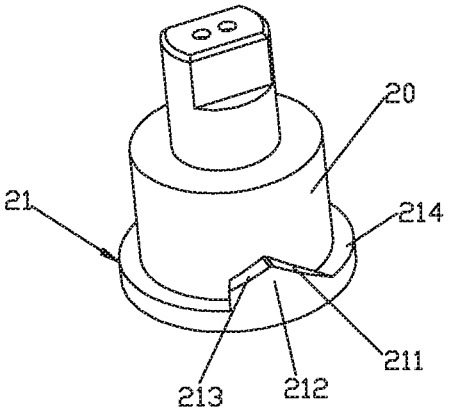
FIG. 4 is a stereoscopic schematic view of the rotating block.
Figure 5:
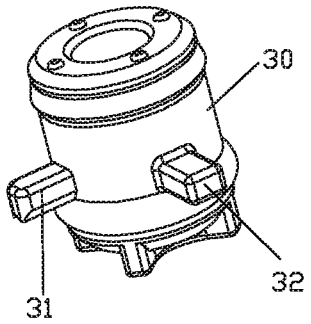
FIG. 5 is a stereoscopic schematic view of the sealing portion.
Figure 6:
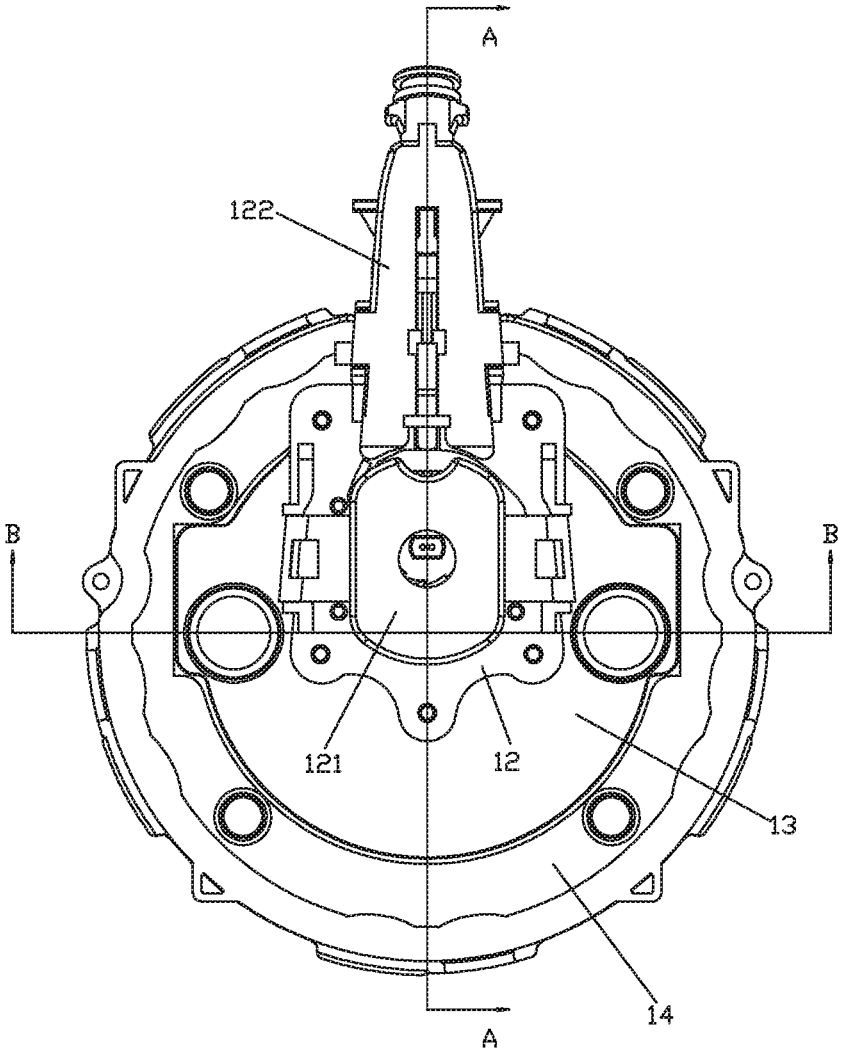
FIG. 6 is a top view of the local assembly of the shower.
Figure 7:
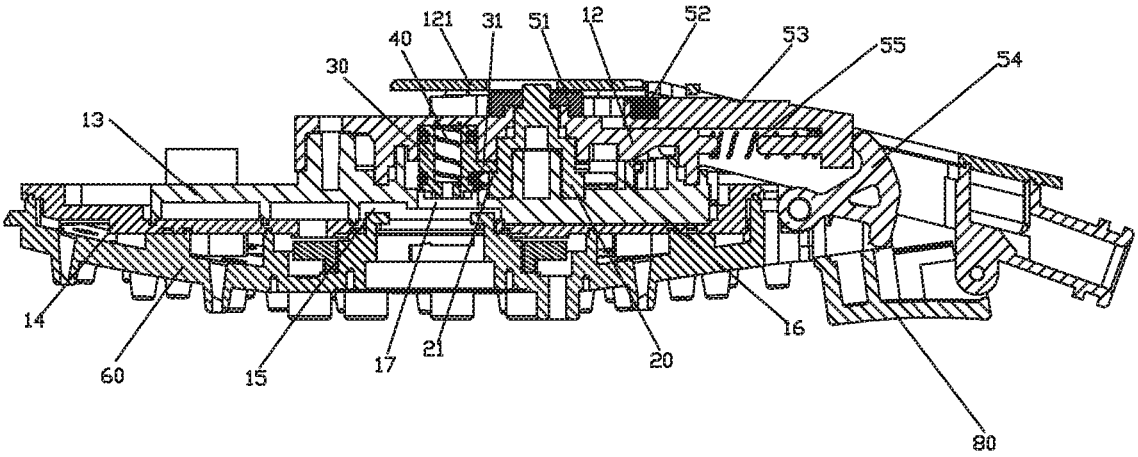
FIG. 7 is a cross-sectional view of the A-A section of FIG. 6, when the water separation hole is in an open state.
Figure 8:
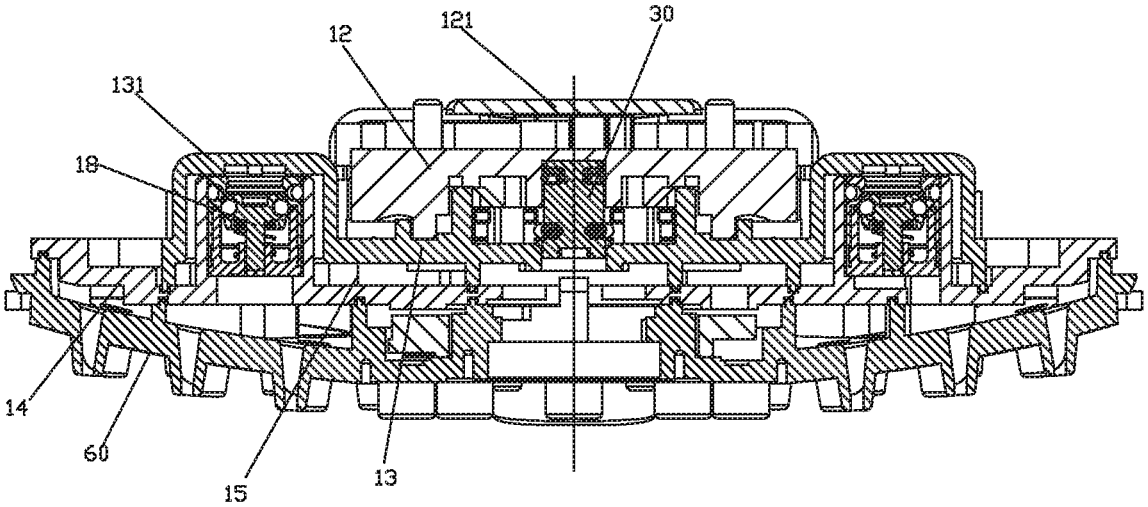
FIG. 8 is a cross-sectional view of the B-B section of FIG. 6.
Figure 9:
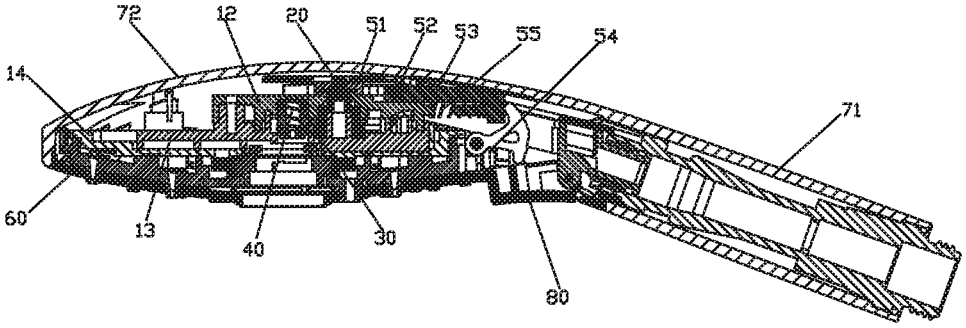
FIG. 9 is a cross-sectional view of the shower.
Figure 10:
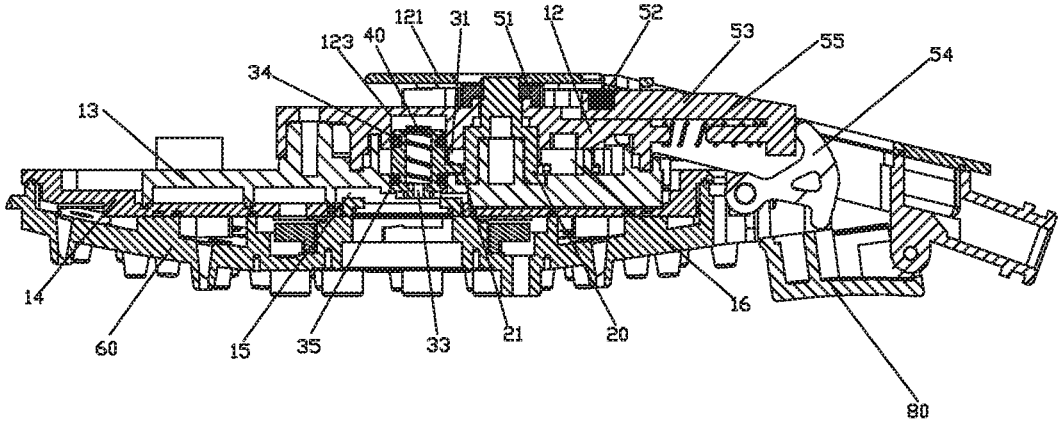
FIG. 10 is a cross-sectional view of the A-A section of FIG. 6, when the water separation hole is in a closed state.

A water switching mechanism, please refer to FIGS. 2 to 8 and 10, includes a fixed portion 10, a rotating block 20 which is connected rotatingly with the fixed portion 10, and a driving mechanism 50. The fixed portion 10 is provided with a plurality of switching positions, each of which is provided with a sealing portion 30 movable in a first direction with respect to the fixed portion 10, each of the sealing portions 30 is provided with an elastic body 40 capable of acting on the sealing portion 30 to generate an elastic force facing the switching position, and the waterway switching is controlled by the action of the sealing portion 30. The plurality of sealing portion 30 are circumferentially spaced apart and surround outside of the rotating block 20 whose rotation axis is parallel to the first direction in which the sealing portion 30 is movable. The outer peripheral wall of the rotating block 20 is provided with a pushing portion 21 which has a positive guiding surface 211 which is also circumferentially extending in the positive direction along the rotation axis of the rotating block 20 and it is also ascending. The structure may or may not be a helical structure, as long as the above conditions are met. The plurality of sealing portions 30 are circumferentially spaced apart and surround outside of the rotating block 20. The first direction intersects the vertical plane perpendicular to the rotation axis of the rotating body 20, for example, the first direction perpendicularly intersects the vertical plane perpendicular to the rotational axis of the rotating block 20 as shown in the drawings of this embodiment. According to the requirement, the non-perpendicular intersection may also be provided, and the corresponding first direction may also intersect the rotation axis of the rotating block 20 non-perpendicularly. Each sealing portion 30 is provided with a fitting portion 31 capable of cooperating with the positive guiding surface 211. When the rotating block 20 is rotated, the guiding surface 211 moves in the circumferential direction following the rotating block 20, the positive guiding surface 211 circumferentially moves to abut fitting portion 31 to cause the sealing portion 30 to move forward in the first direction and compress the elastic body 40 to store energy, and the elastic body 40 is released when the positive guiding surface 211 and the fitting portion 31 are separated, the sealing portion 30 is driven to move in the negative direction along the first direction to reset.

In a specific structure: The rotating block 20 has a protrusion 212 on the periphery wall, and the protrusion 212 has the positive guiding surface 211 and the negative guiding surface 213. The positive guiding surface 211 and the negative guiding surface 213 are connected together, so that the top portion is a vertex angle structure. The negative guiding surface 213 extends along the positive circumferential direction of the rotation axis of the rotating block 20 and gradually decreases in height. The positive guiding surface 211 and the circumferential movement drive the fitting portion 31 to move forward in the first direction, the negative guiding surface 213 and the circumferential movement of the fitting portion 31 drive the fitting portion 31 to cooperate with the elastic body 40 to release energy to gradually move in the negative direction along the first direction to avoid one-step reset in place, to reduce noise, to avoid instant water stoppage and to prolong service life. In a further specific structure, an annular protrusion 214 is protrusionly disposed on an outer circumferential wall of the rotating block 20. The upper surface of the annular protrusion 214 is fixed with the protrusion 212. The upper surface of the protrusion 212 is provided with the positive guiding surface and a negative guiding surface, the fitting portion 31 abuts against the upper surface of the annular protrusion 214, the positive guiding surface and the negative guiding surface.

In a specific structure: The fitting portion 31 includes a lug projecting on the outer peripheral surface of the sealing portion 30, and the lug and the pushing portion are matable.

A guide mechanism is disposed between the fixed portion 10 and the sealing portion 30, such as a second lug 32 protruding from the outer periphery of the fitting portion 31, and the fixed portion 10 is provided with at least one pair of spaced-apart protrusions 11, the second lug 32 are adapted to slide within the pair of protrusions 11 to ensure that the sealing portion 30 is movable in the first direction.

The fixed portion 10 includes a water separation waterway portion and a fixing seat 12. The water separation waterway portion includes a water separation body 13 and a water separation plate 14. The water separation body 13 and the water separation plate 14 are fixed together to form a plurality of water separation waterways 15. The water separation body 13 is concavely provided with a groove, for example, a wall is protrusionly arranged on the water separation body, and the groove is formed in the wall, and the fixing seat 12 is fixedly connected to the water separation body 13 to make the groove form the water separation chamber 16. The part of the water separation body 13 corresponding to the water separation chamber 16 is provided with the above switching position, such as the bottom of the groove. The rotating block 20 is rotatably connected to the water separation body 13 and extends out of the fixing seat from the water separation chamber 16. The sealing portion 30 is slidably connected within the water separation chamber 16. In this embodiment, a part of the switching positions is a water separation hole 17, and the water separation hole 17 is connected to a water separation waterway 15, wherein a water separation hole 17 connects a water separation waterway 15, so that when the water separation hole 17 is opened, the water spray corresponding to the water separation waterway is discharged, or, there is a switching position which is the blind hole, then switch to the switching position to close the water.

Further in this embodiment, the water separation waterway 15 corresponding to the combined water spray includes at least two water outlets, and a one-way valve 18 is disposed at the water outlets to prevent the water from flowing back into the water separation waterway from the water outlet chamber. The water outlet is connected with a water outlet chamber, and the water outlet chamber discharging the corresponding water spray. According to the needs, different water outlet chambers may provide different water sprays; for example, when one water separation waterway is connected to two water outlets, the water outlet chamber of the two water outlets discharge water at the same time to form a combination of spray. In this embodiment, the waterway switching mechanism can achieve a single water spray and an arbitrary mix of water spray, that is, N single water spray can be cooperated with 1-N mixed water spray, the water spray combination has good versatility and the water spray arrangement is abundant (up to 4 single water spray or more mix water spray configuration; any single+ any desired mixed water spray (the total number of the best not more than 6); to achieve a complete water stop needs), it overcomes the traditional separation plate switching problem that it is difficult to achieve single function and any desired mix water spray cycle switching, and with each pressing the button, only one sealing portion move upper to separate water, the sealing contact area is small. it greatly improves the button switching life (to achieve high standard life test requirements: CSA standard can be 150 thousand times the life of the press test (Mixed water); it can withstand 25 million press life test (complete water stop)). The utility model overcomes the problem that when the traditional water separation plate is switched, there is friction between the plastic part and the rubber part of the rotating water separation plate, the friction coefficient is large and the friction force is large.

The driving mechanism 50 includes an intermittent movement mechanism that is drivingly connected to the rotating block to drive the rotating block to rotate in the positive direction. The intermittent moving mechanism includes a ratchet pawl mechanism. The specific structure is that the ratchet pawl mechanism includes a ratchet wheel 51, a ratchet pawl 52 and a sliding seat 53, the ratchet wheel 51 is mounted on the protruding part of the rotating block 20 extending out of the fixed portion (such as the fixed base 12); one end of the ratchet pawl 52 is rotatably connected with the fixed portion 10, such as the top of the fixed seat. The top end of the ratchet pawl 52 abuts against the ratchet of the ratchet wheel 51; the sliding seat 53 can slide relative to the fixed portion, such as sliding relative to the fixed base, the top end of the sliding seat 53 is abutting against the middle of the ratchet pawl. The ratchet pawl is moved so that the end of the ratchet pawl abuts against the ratchet of the ratchet wheel 51 to drive the ratchet wheel 51 to rotate forward to the predetermined angle. According to need, a buckle cover 121 is also included. The buckle cover 121 can be attached to the fixed portion. The cover of the buckle cover is located above the ratchet wheel to prevent the ratchet wheel, the ratchet pawl and the like from being detached from the fixed portion.

In a specific structure, in order to make the structure more compact, the bottom surface of the peripheral portion of the water separation body is concavely formed with a chamber 131 for installing a one-way valve, and the chambers are arranged outside the peripheral wall in a compact structure.

In a specific structure, a groove 123 is recessed on the bottom surface of the fixed base, a hollow hole 33 penetrating up and down is provided in the sealing portion 30, an upper sealing ring 34 and a lower sealing ring 35 spaced apart from each other are provided on the outer wall of the sealing portion 30, The upper part of the sealing portion 30 is always slidably connected in the groove 123. The lower sealing ring 35 is controlled by the vertical movement of the sealing portion 30 to seal the water separation hole to close the water separation hole or away from the water separation hole to open the water separation hole. The upper sealing ring is as a Y-ring, the lower sealing ring is as a circular sealing ring. Moreover, the outer wall has a cylindrical structure. Adopting this concrete structure, the water separation hole can achieve water pressure balance regardless of water flow and water stop state.

Please refer to FIG. 1 to FIG. 10, a shower comprising the waterway switching mechanism as described above, further comprising a face cover 60 and a body 70, the body has a handle portion 71 and a back cover 72, the face cover 60 and the back cover 72 are fixed together and constitute a installation space. The fixed portion 10 is attached in the installation space. A operating member is also provided. The operating member 80 is movably connected to the fixed portion 10 and the rotating block 20 is driven to rotate by the operating member 80. In the specific structure, the face cover 60 is provided with a water outlet port, and the water separation waterway is capable of discharging water through the water outlet port. The operating member 80 is capable of pressingly connecting with the fixed base 12 of the fixed portion 10, for example, the operating member 80 is slidably connected to the fixed base 12, or swingly connected to the fixed seat; it is also provided with a swinging member 54 rotatably connected to the fixed portion 10, both ends of the swinging member 54 are respectively provided with a departing abutting end, one end of the operating member 80 is abutting against the one top abutting end. The other top end is driven to connect intermittent movement mechanism, such as against the tail end of the sliding seat 53. The swinging member can be driven to swing by the action of the operating member 80, the sliding seat can be driven to slide by swinging the swinging member; through sliding the sliding seat, the ratchet pawl can be driven to move, the ratchet wheel can be driven to rotate, and the sealing portion can be driven to be switched. Further, the ratchet wheel ratchet pawl mechanism is further provided with a second elastic body 55 capable of resetting the sliding seat as required, the second elastic body abuts against between the fixed portion 10 and the sliding seat, the tail end of the sliding seat extends downwards to form a baffle, the second elastic body abuts against between the fixed portion and the baffle, and the swinging member abuts against the baffle of the sliding seat; the fixed base 12 is fixed with two separate fork portions 122, The ends of the two fork portions 122 are integrated together to form a water inlet pipe. The sliding seat is connected between the two fork portions. Further comprising a inlet waterway which extends from the water inlet pipe, to the fork portion, to the fixed base and to the water separation chamber.

Figure 11:
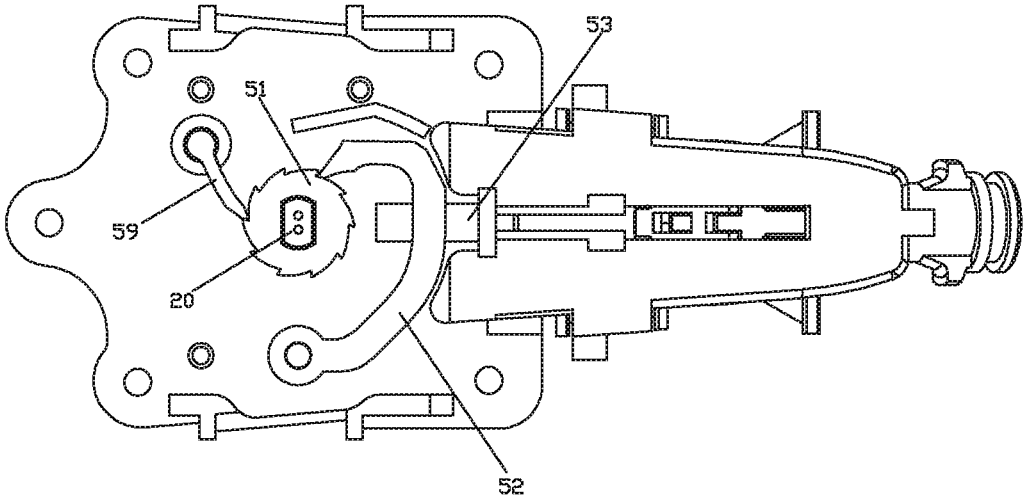
FIG. 11 is a schematic diagram of the structure of the driving mechanism of the second embodiment.

Please refer to FIG. 11, which shows the second embodiment which is different from the first embodiment in that it further comprises a stop claw 59 which is rotatably connected to the fixed base at one end thereof and can abut the ratchet of the ratchet wheel to keep the ratchet wheel in place after it has rotated.

Figure 12:
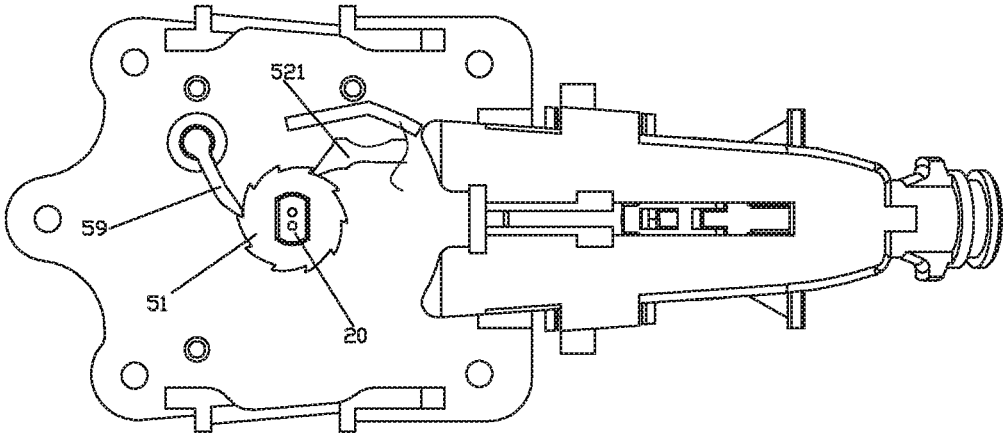
FIG. 12 is a schematic diagram of the structure of the driving mechanism of the third embodiment.
Figures 1, 13:
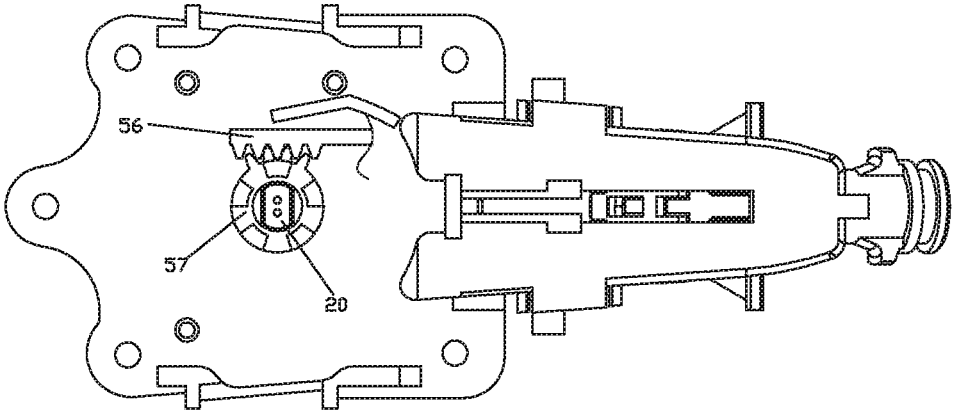
Figures 2, 13:
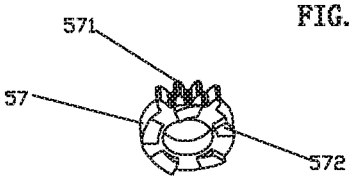
Figures 3, 13:
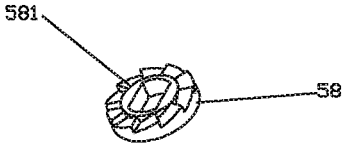

Please refer to FIG. 12, which shows the third embodiment, which is different from the second embodiment in that the ratchet pawl 521 is fixedly connected to the sliding seat, and the ratchet pawl 521 can abut the ratchet. Press the button to move the ratchet pawl to the left (the ratchet pawl moves to the left and will be deformed upwards). The ratchet pawl drives the ratchet wheel to rotate counterclockwise, and the rotating block and the ratchet wheel are fixedly connected. Therefore, the rotating block also rotates counterclockwise to realize the function switching. After the handle is released, the ratchet pawl is reset under the action of a resetting spring (the ratchet pawl moves leftward to generate deformation). The ratchet does not move under the action of the stop ratchet pawl, so that the ratchet wheel rotates intermittently.

Please refer to FIG. 13-1, FIG. 13-2 and FIG. 13-3, which shows the fourth embodiment which is different from the first embodiment in that the intermittent movement mechanism includes a rack 56, a first rotary plate 57 and a second rotary plate 58. A gear 571 is formed on a circumferential wall of the first rotary plate 57. The rack 56 is engaged with the first rotary plate 57. A first ratchet 572 is provided on an end surface of the first rotary plate. The second ratchet 581 is provided on an end surface of the second rotary plate, the first ratchet meshes with the second ratchet and forms a clutch (engaged state and inoperative state). The rack is fixedly mounted on the sliding seat 53. The rack 56 drives the first rotary plate 57 to rotate counterclockwise by the positive rotation of the rack 56. The clutch is in the engagement state and drives the second rotary plate 58 to move counterclockwise. After the handle is released, under the action of the elastic force of the second elastic body, the rack is reset toward the opposite direction to drive the first rotary plate 57 to move clockwise, the clutch is inactive and the first rotary plate 57 runs idle.

Figure 14:
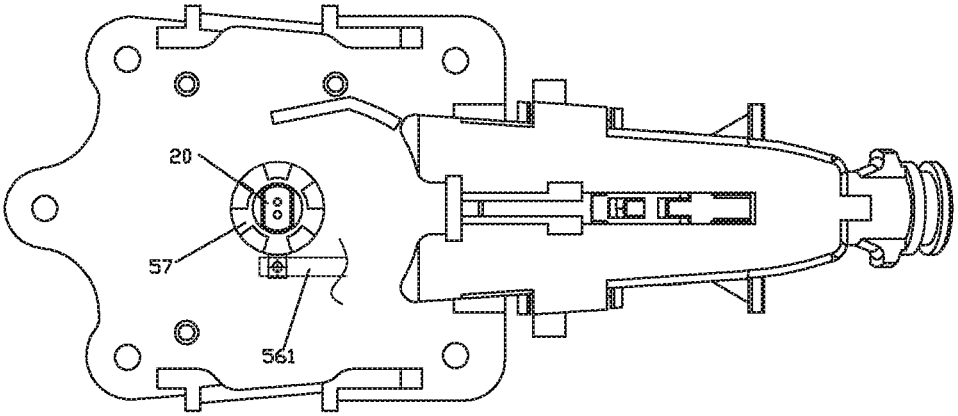
FIG. 14 is a schematic diagram of the structure of the driving mechanism of the fifth embodiment.

Please refer to FIG. 14, which illustrates the fifth embodiment, which is different from the fourth embodiment in that the intermittent movement mechanism includes a pull rod 561, a first rotary plate 57 and a second rotary plate 58. The pull rod cooperates with the first rotary plate to drive the the first rotary plate to rotate; the first rotary plate is provided with a first ratchet tooth on an end surface thereof, and a second ratchet tooth is arranged on the end surface of the second rotary plate, and the first ratchet tooth and the second ratchet tooth are engaged with each other. In the specific structure, one end of the pull rod 561 is rotatably connected to the sliding seat and the other end is rotatably connected to the first rotary plate, the first rotary plate is driven to rotate counterclockwise through the pull rod 561, and the second rotary plate is driven to rotate counterclockwise; the pull rod reset causes the first rotary plate to idle.

The foregoing descriptions are merely exemplary embodiments of the present invention, and therefore, should not be taken as limitations on the scope of the present invention, equivalent changes and modifications based on the scope of the patent and the contents of the specification should be covered by the present invention range.

The invention claimed is:

1. A waterway switching mechanism comprising:

a fixed portion, and a rotating block, wherein:

the fixed portion comprises a plurality of switched positions, each of the plurality of switched positions comprises a sealing portion configured to at least move relative to the fixed portion in a vertical direction, the sealing portions move to control waterway switching, the rotating block is rotatably connected to the fixed portion, an outer peripheral wall of the rotating block extends outward to define a pushing portion, the sealing portions circumferentially surround the rotating block at intervals, each of the sealing portions comprises a fitting portion configured to cooperate with the pushing portion, each of the sealing portions comprises a hollow hole penetrating in at least the vertical direction, a bottom of the fixed portion comprises a plurality of grooves, an upper sealing ring of each of the sealing portions is always slidably connected to a corresponding one of the plurality of grooves, one of the sealing portions at least moves in an upward direction to open a corresponding one of the plurality of switched positions, and when the rotating block rotates:

the pushing portion follows the rotating block to move circumferentially, and the pushing portion drives the fitting portion to at least move along the vertical direction.

2. The waterway switching mechanism according to the claim 1, wherein:

each of the sealing portions is disposed with an elastic body configured to generate an elastic force acting on the sealing portion toward a corresponding one of the plurality of switched positions, a positive movement and a circumferential movement of the pushing portion drives at least one of the fitting portions to at least move forward in the vertical direction and a positive direction to enable a corresponding one of the elastic bodies to store energy, and each of the elastic bodies releases energy and drives a corresponding one of the sealing portions to move in a negative direction and the vertical direction to reset.

3. The waterway switching mechanism according to the claim 1, wherein a rotating axis of the rotating block is parallel to the vertical direction.

4. The waterway switching mechanism according to the claim 2, wherein:

the pushing portion comprises a positive guiding surface and a negative guiding surface, the positive guiding surface extends in the positive direction and a circumferential direction of a rotating axis of the rotating block, a height of the positive guiding surface increases gradually in the positive direction and the vertical direction, the negative guiding surface extends in the positive direction and the circumferential direction of the rotating axis of the rotating block, a height of the negative guiding surface decreases gradually in the positive direction and the vertical direction, the fitting portion is driven to move in the positive direction and the vertical direction due to a circumferential movement of the pushing portion, and the fitting portion is driven to move gradually in the negative direction and the vertical direction.

5. The waterway switching mechanism according to the claim 1, wherein:

the outer peripheral wall of the rotating block comprises an annular protrusion, and an upper ring surface of the annular protrusion defines the pushing portion.

6. The waterway switching mechanism according to the claim 1, wherein:

each of the fitting portions comprises a lug disposed on an outer surface of a corresponding one of the sealing portions, and the lugs cooperate with the pushing portion.

7. The waterway switching mechanism according to the claim 1, wherein a guiding mechanism is disposed between the fixed portion and a corresponding one of the sealing portions.

8. The waterway switching mechanism according to the claim 7, wherein:

at least two second lugs extend outward from an outer periphery of each of the fitting portions, the fixed portion comprises at least one pair of protrusions disposed at intervals, the at least two second lugs and the at least one pair of protrusions define the guiding mechanism, and the at least two second lugs are slidably connected to a corresponding pair of the at least one pair of protrusions to enable the corresponding one of the sealing portions to at least move in the vertical direction.

9. The waterway switching mechanism according to the claim 8, wherein:

a gap is disposed between the at least two second lugs and the at least one pair of protrusions.

10. The waterway switching mechanism according to the claim 1, wherein:

the fixed portion comprises a water separation waterway portion and a fixed seat, the water separation waterway portion is fixedly connected to the fixed seat to define a water separation chamber, a portion of the water separation waterway portion corresponding to the water separation chamber comprises the plurality of switched positions, at least one of the plurality of switched positions is a water separation hole, at least one water separation waterway corresponding to the water separation hole is disposed in the water separation waterway portion, and the rotating block is rotatably connected to the water separation waterway portion and extends out of the fixed seat.

11. The waterway switching mechanism according to the claim 10, wherein:

a bottom of the fixed seat comprises the plurality of grooves each of the sealing portions is disposed with an upper sealing ring and a lower sealing ring, one of the sealing portions at least moves in a downward direction to control the lower sealing ring to seal a corresponding one of the plurality of switched positions to close the corresponding one of the plurality of switched positions, one of the sealing portions at least moves in the upward direction to control the lower sealing ring to open the corresponding one of the plurality of switched positions.

12. The waterway switching mechanism according to the claim 10, wherein:

the at least one water separation waterway comprises at least two water outlet ports, and each of the at least two water outlet ports is disposed with a one-way valve.

13. The waterway switching mechanism according to the claim 10, wherein at least one of the plurality of switched positions is a blind hole.

14. The waterway switching mechanism according to the claim 1, comprising:

a driving mechanism, wherein:

the driving mechanism comprises an intermittent movement mechanism, and the intermittent movement mechanism is connected to the rotating block to drive the rotating block to rotate in a positive direction.

15. The waterway switching mechanism according to the claim 14, wherein the intermittent movement mechanism comprises a ratchet wheel-ratchet pawl mechanism.

16. The waterway switching mechanism according to the claim 14, wherein:

the intermittent movement mechanism comprises a rack, a first rotary plate and a second rotary plate, a peripheral wall of the first rotary plate defines gear teeth, the rack engages with the first rotary plate, an end surface of the first rotary plate comprises a first ratchet tooth, an end surface of the second rotary plate comprises a second ratchet tooth, and the first ratchet tooth engages with the second ratchet tooth.

17. The waterway switching mechanism according to the claim 14, wherein:

the intermittent movement mechanism comprises a pull rod, a first rotary plate and a second rotary plate, the pull rod cooperates with the first rotary plate to drive the first rotary plate to rotate upon movement of the pull rod, an end surface of the first rotary plate comprises a first ratchet tooth, an end surface of the second rotary plate comprises a second ratchet tooth, and the first ratchet tooth engages with the second ratchet tooth.

18. A waterway switching mechanism, comprises:

a fixed portion, and a rotating block, wherein:

the fixed portion comprises a plurality of switched position, each of the plurality of switched position comprises a sealing portion configured to at least move relative to the fixed portion in a vertical direction, the sealing portions move to control waterway switching, the rotating block is rotatably connected to the fixed portion, an outer peripheral wall of the rotating block comprises a pushing portion, the pushing portion comprises a positive guiding surface, the positive guiding surface extends in a positive direction and a circumferential direction of a rotating axis of the rotating block, a height of the positive guiding surface increases gradually in the positive direction and the vertical direction, the sealing portions circumferentially surround an outside of the rotating block at intervals, each of the sealing portions comprises a fitting portion configured to cooperate the positive guiding surface, each of the sealing portions comprises a hollow hole penetrating in at least the vertical direction, a bottom of the fixed portion comprises a plurality of grooves, an upper sealing ring of each of the sealing portions is always slidably connected to a corresponding one of the plurality of grooves, one of the sealing portions at least moves in an upward direction to open a corresponding one of the plurality of switched positions, and when the rotating block rotates:

the positive guiding surface follows the rotating block to move circumferentially, and the positive guiding surface drives the fitting portion to at least move along the vertical direction.

19. A shower comprising the waterway switching mechanism according to claim 1, comprising:

a face cover, an operation member, and a body, wherein:

the body comprises a handle portion and a rear cover, the face cover is fixedly connected to the rear cover to define an installation space, the fixed portion is disposed in the installation space, and the operation member is movably connected to the fixed portion to drive the rotating block to rotate due to a movement of the operation member.

20. A shower comprising the waterway switching mechanism according to claim 18, comprising:

a face cover, an operation member, and a body, wherein:

the body comprises a handle portion and a rear cover, the face cover is fixedly connected to the rear cover to define an installation space, the fixed portion is disposed in the installation space, and the operation member is movably connected to the fixed portion to drive the rotating block to rotate due to a movement of the operation member.

* * * * *